US007607930B1

(12) United States Patent
Wu

(10) Patent No.: US 7,607,930 B1
(45) Date of Patent: Oct. 27, 2009

(54) CABLE CONNECTOR ASSEMBLY HAVING IMPROVED FIXING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/221,692

(22) Filed: Aug. 5, 2008

(51) Int. Cl.
*H01R 13/74* (2006.01)

(52) U.S. Cl. ..... 439/247; 439/378; 439/557; 439/573

(58) Field of Classification Search ..... 439/246, 439/247, 248, 378, 557, 564, 565, 567, 571, 439/572, 573, 574, 575
See application file for complete search history.

(56) References Cited

U.S. PATENT DOCUMENTS 5,066,237 A * 11/1991 Shiley ..... 439/82
5,266,052 A * 11/1993 Phillips, II ..... 439/562
5,616,052 A * 4/1997 Pan et al. ..... 439/573
6,086,418 A * 7/2000 Chang ..... 439/573
6,648,676 B1 * 11/2003 Lee ..... 439/499
6,736,659 B1 * 5/2004 Wu ..... 439/247
6,773,286 B1 * 8/2004 Wu ..... 439/247
6,824,419 B1 * 11/2004 Wu ..... 439/378
6,830,483 B1 * 12/2004 Wu ..... 439/638
6,832,931 B1 * 12/2004 Wu ..... 439/499
6,890,200 B1 * 5/2005 Wu ..... 439/247
6,896,556 B1 5/2005 Wu
6,923,679 B1 * 8/2005 Wu ..... 439/573
2008/0145186 A1 * 6/2008 Jin ..... 411/480

* cited by examiner

*Primary Examiner*—James Harvey
(74) *Attorney, Agent, or Firm*—Wei Te Chung; Andrew C. Cheng; Ming Chieh Chang

(57) ABSTRACT

A cable connector assembly (100) is assembled to a panel (300) defining a pair of insertion holes (32). The cable connector assembly includes a first housing (1), a number of first and second terminals (21, 22) assembled to the first housing, a cable (9), a second housing (7) assembled to the first housing, and a pair of fixing members. The first housing has a pair of mounting holes defined at opposite sides thereof. Each fixing member includes a screw (5) defining a screw recess (521) engageable with the insertion hole of the panel, and a screw cap (6) including a gasket (61) defining a through hole (611) engageable with the screw recess of the screw and a number of tabs (62) radially protruding from the gasket and resisting against the mounting hole.

14 Claims, 8 Drawing Sheets

CABLE CONNECTOR ASSEMBLY HAVING IMPROVED FIXING MEMBER

BACKGROUND OF THE INVENTION

1. Field of the Invention

The present invention relates to a cable connector assembly, and particularly to a cable assembly having a cable connector and a power adapter respectively for signal and power transmission.

2. Description of Related Art

In recent days, an electrical connector known as a Serial Advanced Technology Attachment (Serial ATA) connector, according to the newly developed Serial ATA interface standard, is developed to be generally used for connecting storage peripheral devices such as hard disk drives with a mother printed circuit panel so as to achieve signal or power transmission therebetween. The Serial ATA connector has many advantages such as low voltage requirement, low pin count and high speed transmission.

A cable connector assembly is described in U.S. Pat. No. 6,896,556 issued on May 24, 2005. The cable connector assembly comprises a first housing extending in a lengthwise direction and a number of first and second contacts received in the first housing in a lateral direction perpendicular to the lengthwise direction, a cable including a number of conductors electrically connecting with the first contacts, a second housing back to back assembled to the first housing and a number of third contacts electrically connecting with the first contacts, a panel, a pair of screws inserting through the first housing and the panel, and a pair of screw caps engaging with the screws. The screw and the screw cap respectively has mutual cooperated screw thread. The panel could be fixed onto the first housing via the engagement between the screw thread of the screws and the screw thread of the screw caps.

When the screw and the screw cap are used for a lot of times and the screw thread of the screw and the screw thread of the screw cap are abrased, the engagement between the screw and the screw cap is not reliable enough for fastening the panel onto the first housing.

Hence, a cable connector assembly having an improved fixing member is highly desired.

SUMMARY OF THE INVENTION

Accordingly, an object of the present invention is to provide a cable connector assembly having an improved fixing member adapted for performing a reliable fixing function.

In order to achieve the object set forth, a cable connector assembly in accordance with the present invention is assembled to a panel defining a pair of insertion holes. The cable connector assembly comprises a first housing extending in a first direction perpendicular to a mating direction, a plurality of first and second terminals assembled to the first housing along the mating direction, a cable, a second housing assembled to the first housing in said mating direction, a pair of fixing members. The first housing has a base portion, a mating portion and a pair of mounting holes defined at opposite sides of the base portion. Each first and second terminal comprises a contact portion and a tail portion. The cable comprises a plurality of conductors electrically connecting with the tail portions of the first terminals. The second housing has a plurality of third terminals electrically connecting with the tail portions of the second terminals. Each fixing member includes a screw defining a screw recess engageable with the insertion hole of the panel, and a screw cap including a gasket defining a through hole engageable with the screw recess of the screw and a number of tabs radially protruding from the gasket and resisting against the mounting hole.

The through hole of the screw cap engages with the screw recess of the screw, and the tabs of the screw cap abut against the first mounting hole. The engagement between the screw and the screw cap is reliable, since it is not established via the abrasable screw thread.

Other objects, advantages and novel features of the invention will become more apparent from the following detailed description when taken in conjunction with the accompanying drawings.

DETAILED DESCRIPTION OF THE PREFERRED EMBODIMENT

Figure 1:
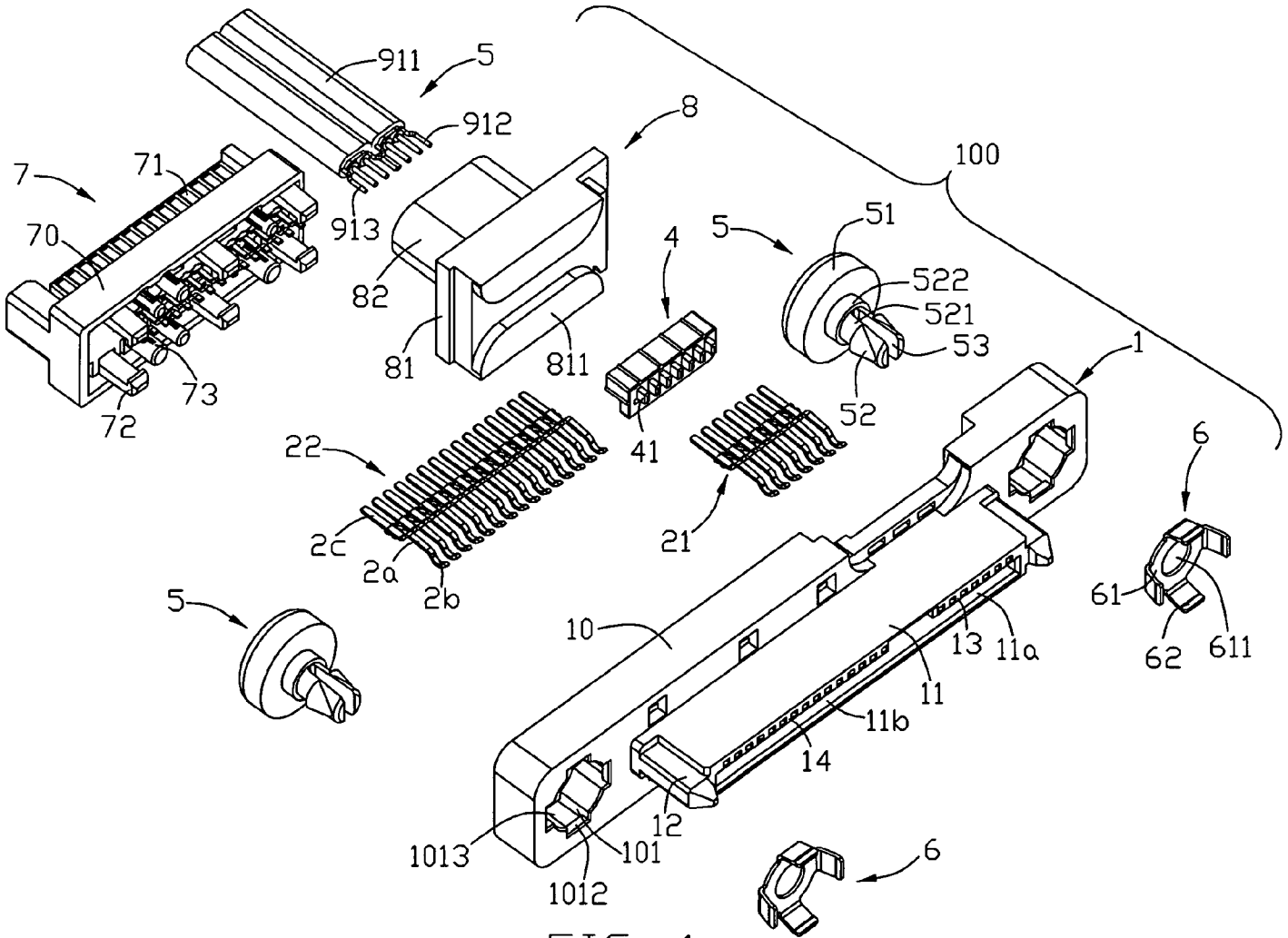
FIG. 1 is an exploded perspective view of a cable connector assembly in accordance with the present invention.

Reference will now be made in detail to the preferred embodiment of the present invention.

Referring to FIGS. 1-4 and 8, a cable connector assembly 100 adapted for mating with a panel 300 in accordance with the present invention comprises a first housing 1, a plurality of terminals, a retention portion 4 retained in the first housing 1, a second housing 7 assembled to the first housing 1, a cable 9 connected to the first housing 1 via a connecting portion 8, a pair of screws 5 and a pair of screw caps 6 engaging with the screws 5. The screw 5 and the corresponding screw cap 6 are cooperated as a fixing member.

The first housing 1 has an elongated base portion 10 and a mating portion 11 extending perpendicularly and forwardly from a front face of the base portion 10. The mating portion 11 has a pair of protruding posts 12 disposed at opposite ends thereof for guiding the cable connector assembly 1 to mate with a complementary connector (not shown) along a mating direction.

Figure 2:
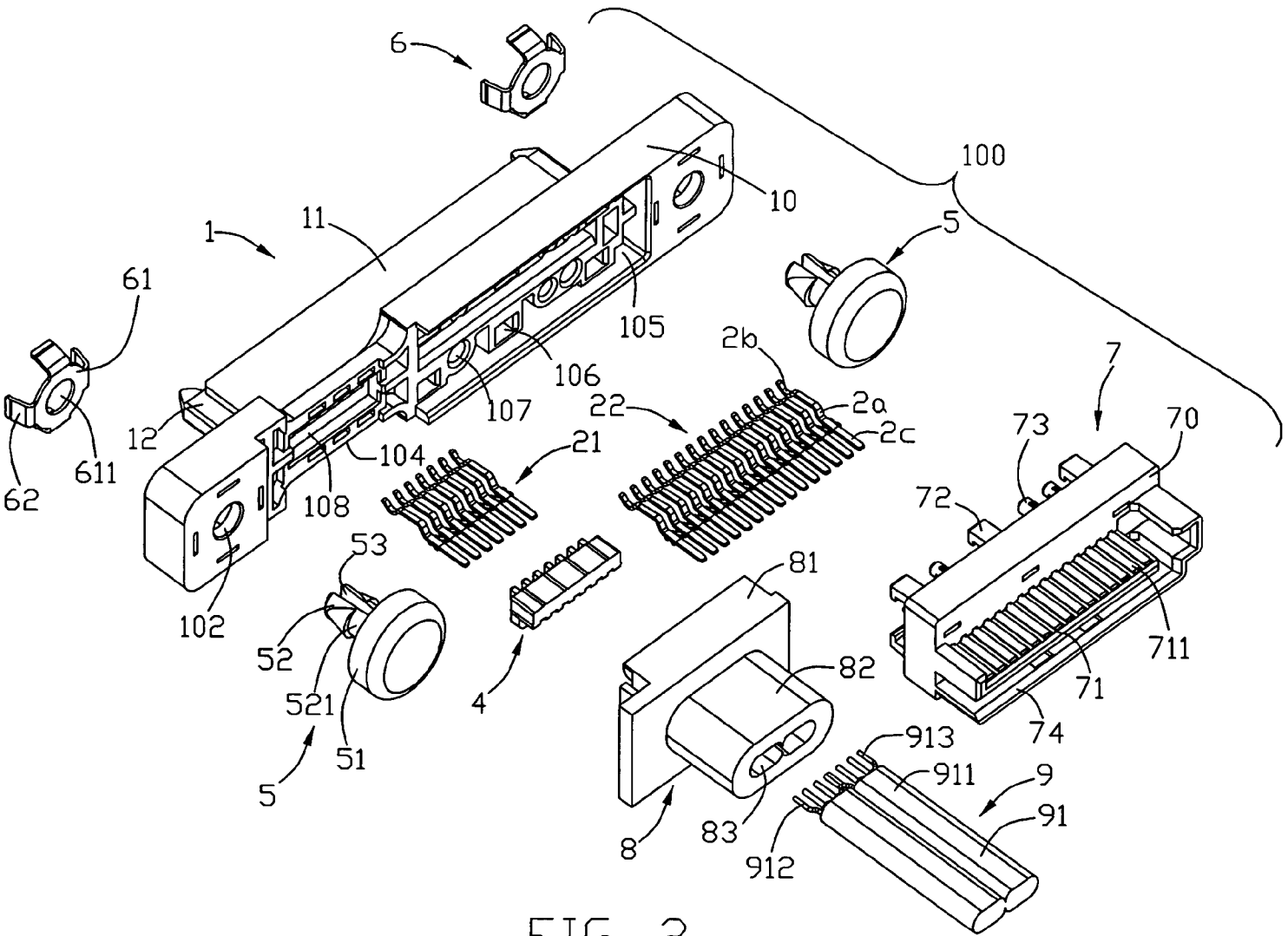
FIG. 2 is a view similar to FIG. 1, taken from another aspect.
Figure 3:
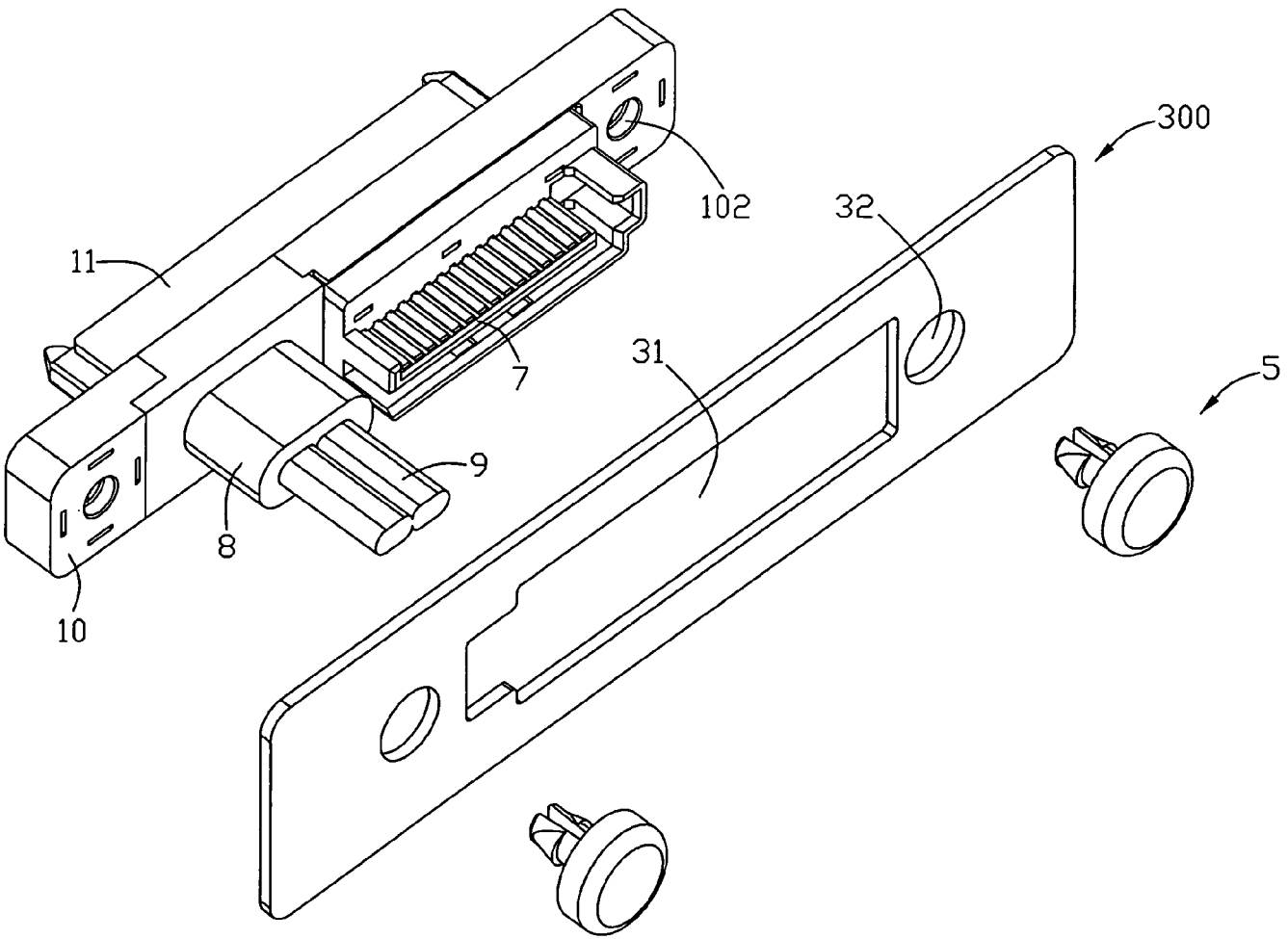
FIG. 3 is partially assembled perspective view showing the cable connector assembly are not mounted on the panel.
Figure 4:
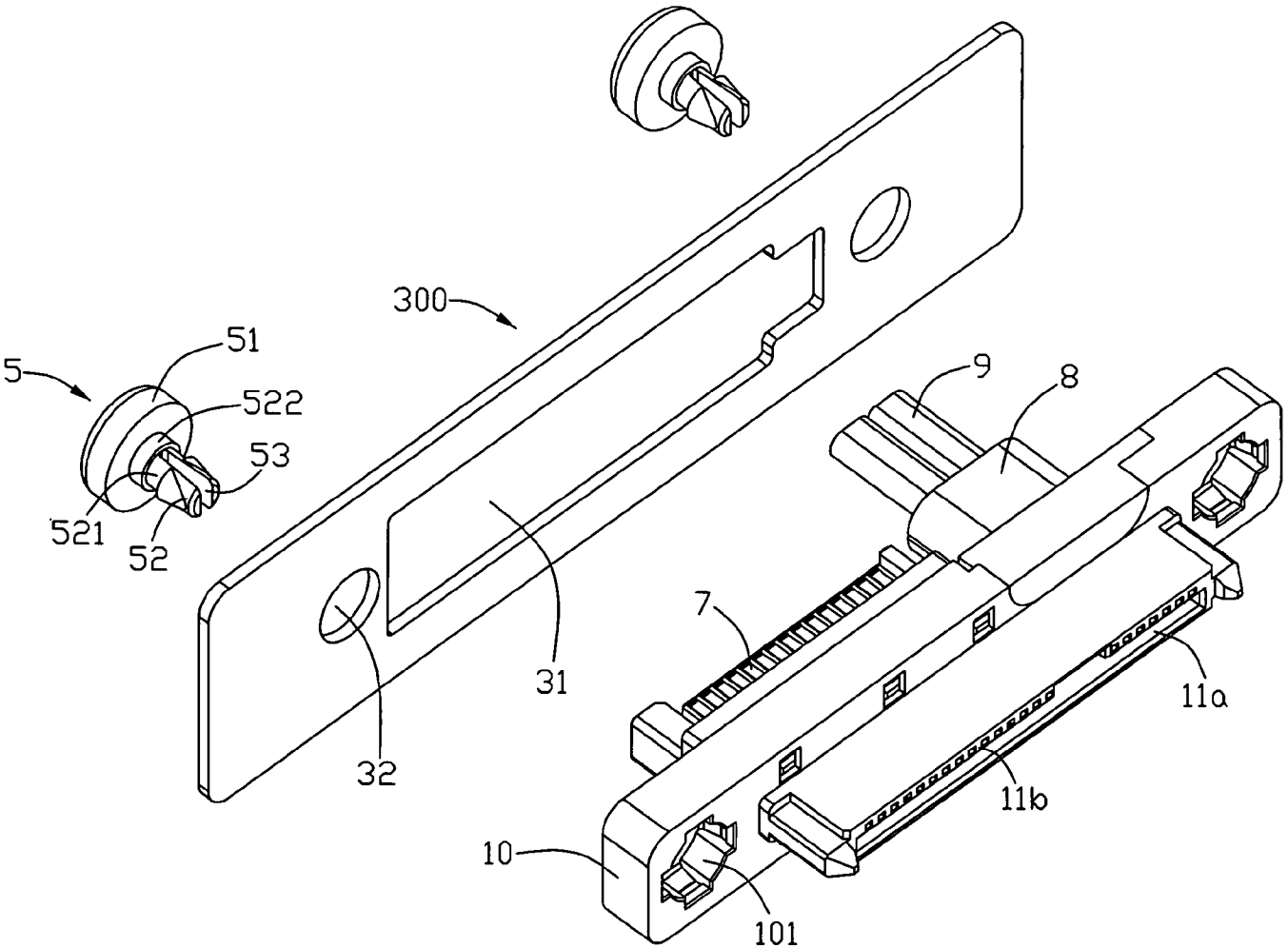
FIG. 4 is a view similar to FIG. 3, taken from another aspect.
Figure 5:
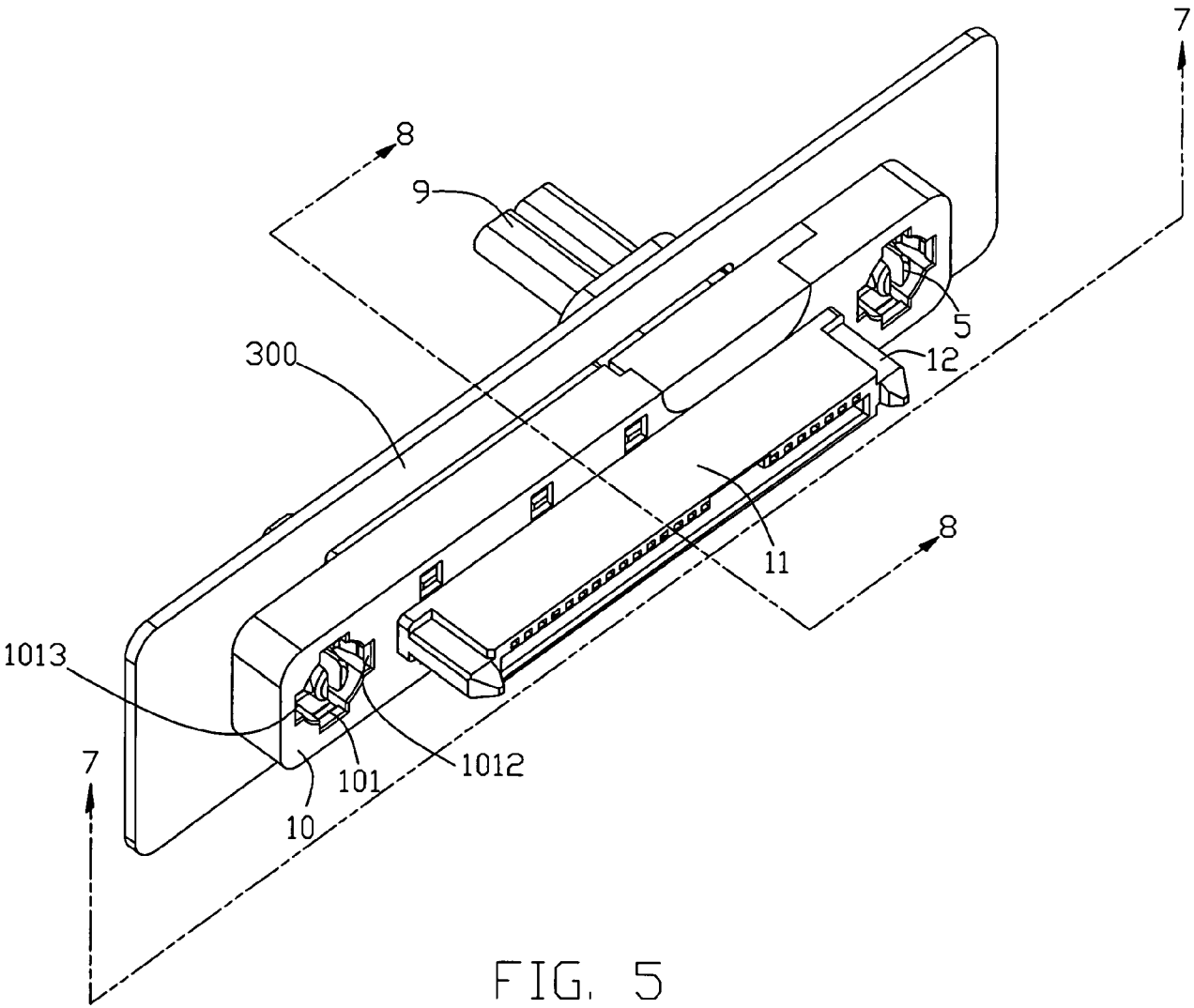
FIG. 5 is an assembled perspective view showing the connector assembly mounted on the panel.
Figure 6:
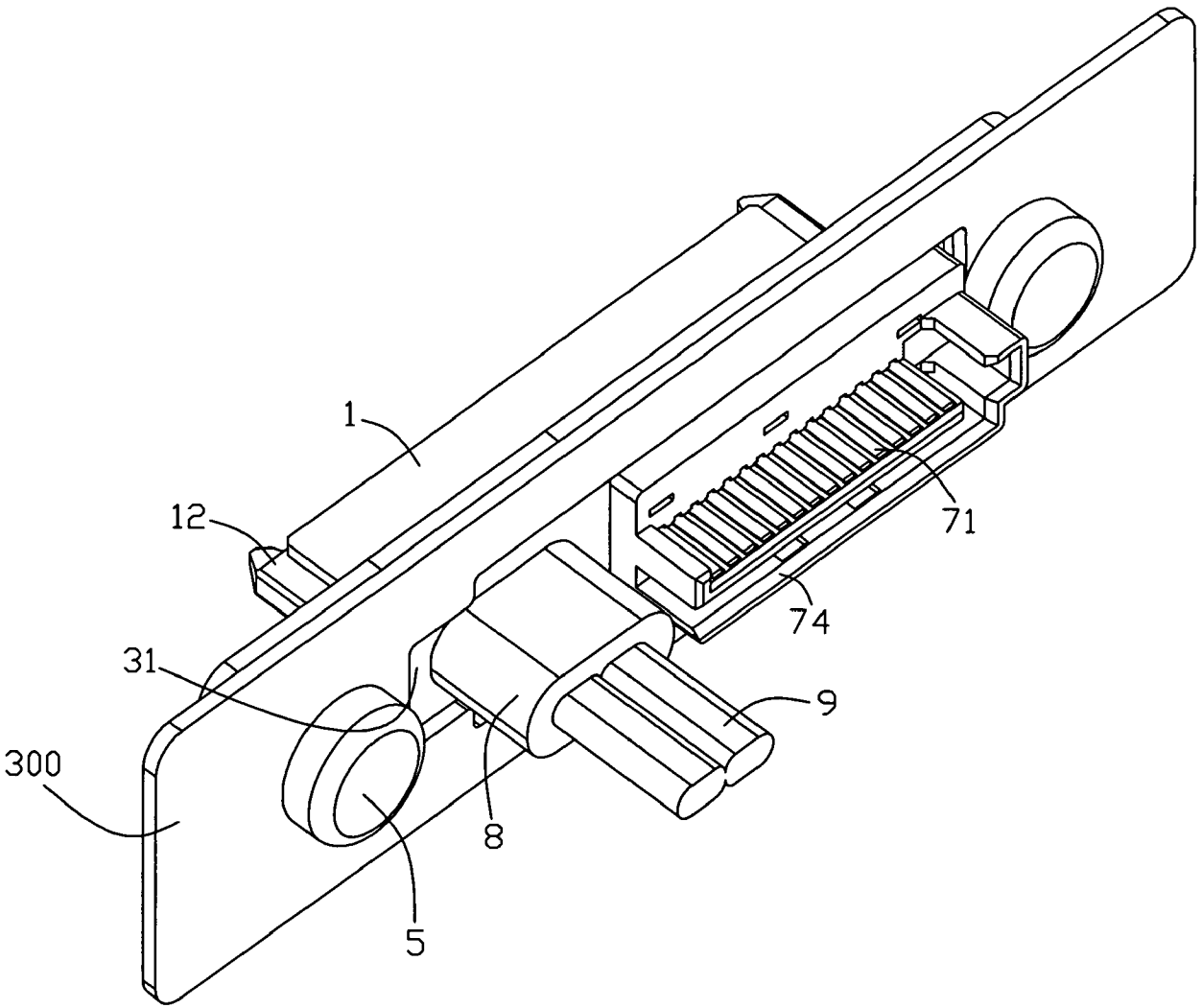
FIG. 6 is a view similar to FIG. 5, taken from another aspect.

Referring to FIGS. 1-3 in conjunction with FIGS. 5-6, the mating portion 11 includes a first and a second mating ports 11*a*, 11*b* arranged in a side-by-side manner wherein the first mating port 11*a* has a lengthwise dimension smaller than that of the second mating port 11*b*. The base portion 10 defines a cavity 105 extending therethrough to communicate with the second mating port 11*b*, and a plurality of circular holes 107 and rectangular slots 106 located at upper and lower sides of the cavity 105. The base portion 10 is formed with a step portion 109 (shown in FIG. 8) in each slot 106. The base portion 10 defines a receiving space 108 corresponding to the first mating port 11*a* in a rear face thereof, and a pair of depressions 104 communicating with the receiving space 108 in top and bottom faces thereof. The first housing 1 defines a plurality of first passageways 13 communicating with the first mating port 11*a* and the receiving space 108, and a plurality of second passageways 14 communicating with the second mating port 11*b* and the cavity 105.

A front face of the base portion 10 defines a pair of first mounting holes 101 at opposite sides of the mating portion 11. A rear face of the base portion 10 defines a pair of circular second mounting holes 102. The first mounting hole 101 and corresponding second mounting hole 102 are communicated with each other to form themselves as a mounting hole. The first mounting hole 101 has a plurality of indentations 1013 distributed therearound. Each indentation 1013 is concaved from the inner surface of the first mounting hole 101. In conjunction with FIG. 7, the first mounting hole 101 has a cushion 1011 formed therein and a blocking portion 1012 formed in each indentation 1013.

Figure 8:
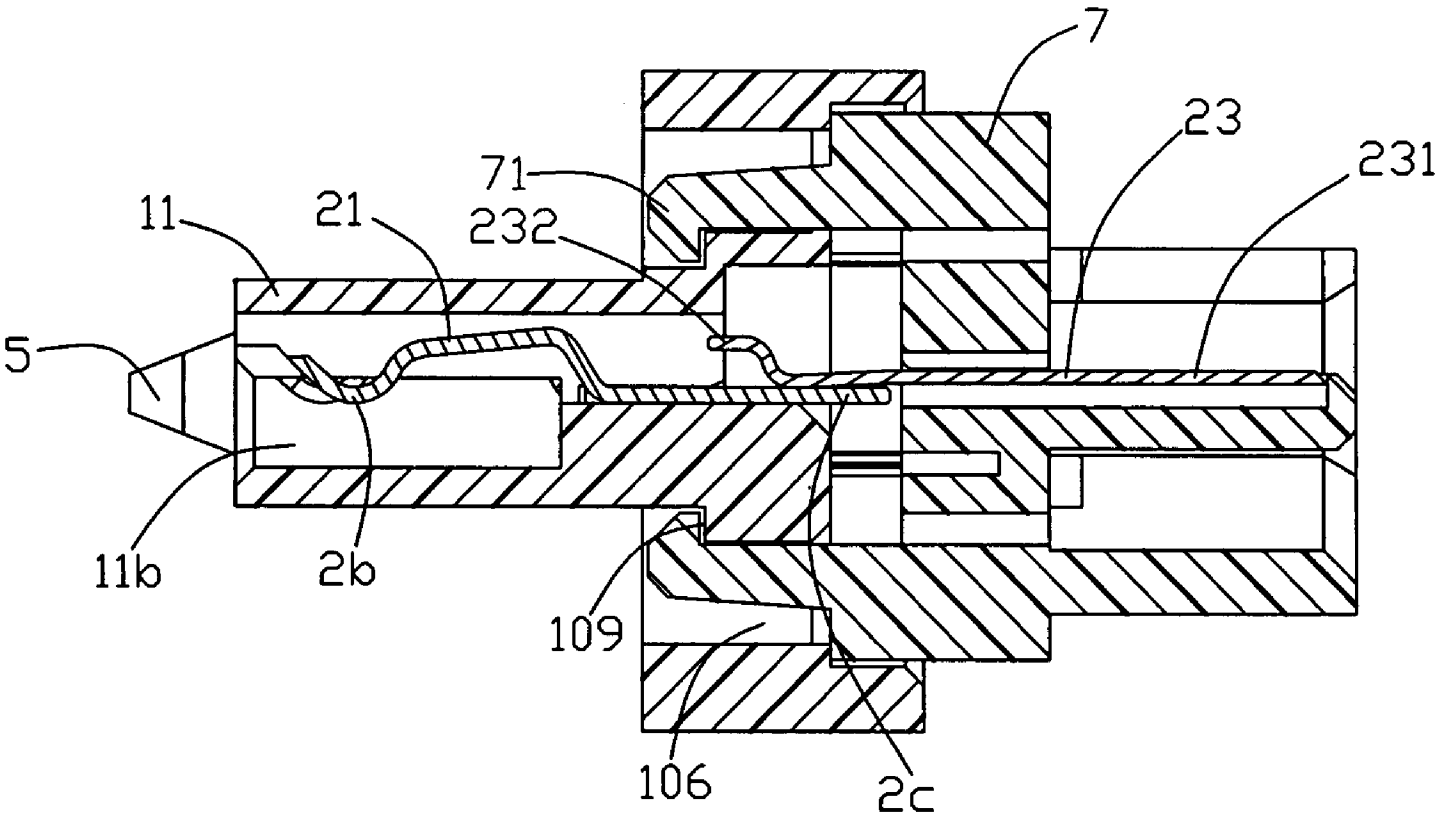
FIG. 8 is another cross-sectional view taken along line 8-8 of FIG. 5.

The terminals include the first and second terminals 21, 22 as shown in FIGS. 1-2, and third terminals 23 as shown in FIG. 8. The first terminals 11 has four signal terminals and three ground terminals. The second terminals 22 are power terminals. Each first or second terminal 2 includes a contact portion 2*b*, a tail portion 2*c*, and an intermediate portion 2*a* interconnecting the contact portion 2*b* and the tail portion 2*c*. Each third terminal 23 has a flat portion 231 and a Z-shaped engaging portion 232 connected with the flat portion 231.

Referring to FIGS. 1-2, each screw cap 5 comprises a base portion 51, a post portion 52 having a threaded slit 53 defined through the post portion 52. The post portion 52 has a platform 522 raised from the base portion 51, a threaded recess 521 defined abode the platform 522. The screw cap 6 comprises a gasket 61 defining a through hole 611, and four tabs 62 radially extending from the gasket 61.

The retention portion 4 has a plurality of third passageways 41 defined therein.

The second housing 7 includes a body portion 70, a tongue portion 71 extending rearwardly from a middle portion of the body portion 70 for mating with a complementary second connector (not shown), and a plate 74 extending rearwardly from the body portion 70 and parallel to the tongue portion 71 for latching with the complementary second connector. The second housing 7 defines a plurality of channels 711 extending from the tongue portion 71 through the body portion 70. The body portion 70 is formed with a plurality of locking beams 72 and posts 73.

The connecting portion 8 comprises a base wall 81 and a nose portion 82 protruding rearwardly from a rear face of the base wall 81. The nose portion 82 has a pair of insertion slots 83 extending through the connecting portion 8. The base wall 81 comprises a pair of protrusions 811 formed at a bottom surface thereof.

The cable 9 comprises a pair of wires 91 each includes an insulative jacket 911, a pair of differential signal conductors 912 and a pair of ground conductors 913 exposed out of the jacket 911 at one end thereof.

The panel 300 defines an opening 31 in a middle portion thereof and a pair of circular insertion holes 32 at opposite sides of the opening 31.

Figure 7:
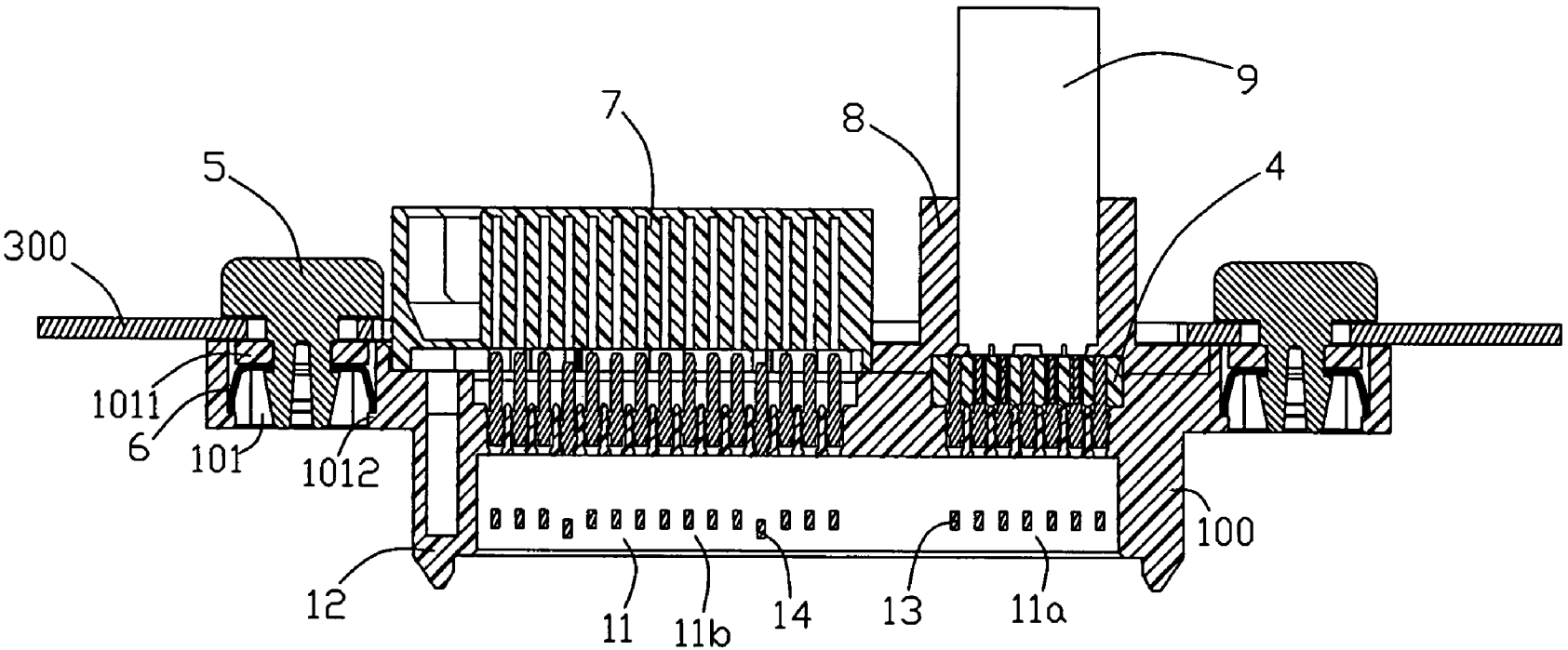
FIG. 7 is an cross-sectional view taken along line 7-7 of FIG. 5.

In conjunction with FIGS. 7-8, in assembly of the cable connector assembly 100, the first terminals 21 are inserted in third passageways 41 of the retention portion 4. The retention portion 4 together with the first terminals 21 are mounted in the receiving space 108 of the first housing 1, with the intermediate portions 2*a* of the first terminals 21 retained in the first passageways 13 and the contact portions 2*b* exposed in the first mating port 11*a*. The second terminals 22 are inserted into the second passageways 14 of the first housing 1 along the mating direction, with the contact portions 2*b* thereof exposed in the second ports 11*b*. Four signal conductors 912 of the cable 9 are respectively soldered with the tail portions 2*c* of the four signal terminals of the first terminals 21. One of the ground conductors 913 of each wire 91 is soldered with the tail portion 2*c* of a corresponding ground terminal of the first terminal 21, other two ground conductors 913 of the wires 91 are soldered to a common ground contact of the first terminal 21.

The connecting portion 8 is overmolded with the cable 9 and the first housing 1 after the wires 91 are inserted through the insertion slots 83 and are soldered with the first terminals 21. The protrusions 811 of the base wall 81 are plunged into the depressions 104.

The second housing 2 is back to back assembled to the first housing 1 with the posts 73 received in the holes 107 of the first housing 1 and with the locking beams 72 locking with the step portions 109 of the slots 106 to thereby interlocking the first housing 1 with the second housing 7. The tail portions 2*c* of the second terminals 22 disposed in the cavity 105 and resiliently contact with the engaging portions 232 of the third terminals 23.

The panel 300 is attached to the rear face of the first housing 1, with the second housing 7 and the retention portion 8 together with the cable 9 extending outwardly from the opening 31, and the insertion holes 32 aligned with corresponding second mounting holes 102. Each screw 5 is inserted into the insertion hole 32 of the panel 300 and then engaged with the second mounting hole 102 of the first housing 1. Each screw cap 6 is embedded in the first mounting hole 101 and engaged with the post portion 52 of the screw 5, with the through hole 611 engaging with the threaded recess 521. The cushion 1011 is plunged in the threaded recess 521. The tabs 62 of the screw cap 6 are plunged in the indentations 1013 and are abutted along the inner surface of the indentations 1013. The tabs 62 of the screw cap 6 are resisted against by the blocking portions 1012 and are prevented from separating the screw cap 6 away from the first mounting hole 101.

It can be understood that the cable connector assembly 100 is formed by integrating a cable connector with a power adaptor, wherein the cable connector comprises the first terminals 21 received in the first mating port 11*a* of the first housing 1 and the cable 3 electrically connecting with the first terminals 21 for signal transmission, and wherein the power adaptor includes the second terminals 21 received in the second mating port 11*b* of the first housing 1 and the second housing 7 electrically connecting with the second terminals 22 for power transmission.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly assembled to a panel defining a pair of insertion holes, said cable connector assembly comprising:

a first housing extending in a first direction perpendicular to a mating direction, said first housing having a base portion, a mating portion protruding from the base portion and a pair of mounting holes defined at opposite sides of the base portion;

a plurality of first and second terminals assembled to the first housing along the mating direction, each of the first and second terminals comprising a contact portion and a tail portion;

a cable comprising a plurality of conductors electrically connecting with the tail portions of the first terminals;

a second housing assembled to the first housing in said mating direction and having a plurality of third terminals electrically connecting with the tail portions of the second terminals; and a pair of fixing members insertable in the mounting hole, each fixing member comprising a screw defining a screw recess engageable with the insertion hole of the panel, and a screw cap comprising a gasket defining a through hole engageable with the screw recess of the screw and a plurality of tabs radially protruding from the gasket and resisting against the mounting hole.

2. The cable connector assembly as claimed in claim 1, wherein said mounting hole comprises a first mounting hole defined on a front face of the first housing, and a second mounting hole defined on a rear face of the first housing and communicated with the first mounting hole.

3. The cable connector assembly as claimed in claim 2, wherein said first mounting hole has a plurality of indentations distributed therearound, each indentation concaved from an inner surface of the first mounting hole for engaging with corresponding tab of the screw cap.

4. The cable connector assembly as claimed in claim 3, wherein each indentation of the first mounting hole is formed with a blocking portion resisting against the tab of the screw cap for preventing the screw cap from separating from the first mounting hole along the mating direction.

5. The cable connector assembly as claimed in claim 1, wherein said screw comprises a base portion and a post portion raised from the base portion, said screw recess defined around the post portion, and wherein said mounting hole is formed with a cushion engageable with the screw recess of the screw.

6. The cable connector assembly as claimed in claim 5, wherein said post portion of the screw has a slit defined therethrough.

7. The cable connector assembly as claimed in claim 1, wherein said first terminals comprise signal and ground terminals, said second and third terminals are power terminals.

8. The cable connector assembly as claimed in claim 7, wherein said conductors of the cable comprise signal and ground conductors respectively connecting with the signal and ground terminals of the first terminals.

9. The cable connector assembly as claimed in claim 7, wherein said second terminals electrically connect with the third terminals in a one on one relationship.

10. The cable connector assembly as claimed in claim 1, wherein said mating portion comprises a first mating port and a second mating port, said contact portions of the first and second terminals are respectively exposed in the first and second mating ports.

11. The cable connector assembly as claimed in claim 10, wherein said base portion defines a receiving space communicating with the first mating port and a cavity communicating with the second mating port.

12. The cable connector assembly as claimed in claim 11, further comprising a retention portion maintaining the first terminals and mounted in the receiving space of the first housing.

13. The cable connector assembly as claimed in claim 11, wherein said second housing is formed with a plurality of locking beams and posts, said cavity of the first housing defines a plurality of slots and holes respectively engaging with the locking beams and posts.

14. The cable connector assembly as claimed in claim 1, further comprising a connecting portion overmolded with the cable and mounted onto the first housing.

* * * * *